United States Patent [19]

Kim

[11] Patent Number: 4,872,585

[45] Date of Patent: Oct. 10, 1989

[54] TRASH CONTAINER TO BE CHEMICAL SPRAYED

[76] Inventor: Il Yoo Kim, 7953 Audubon Ave., B-7, Alexandria, Va. 22306

[21] Appl. No.: 257,882

[22] Filed: Oct. 14, 1988

[51] Int. Cl.[4] ..... B65D 43/14

[52] U.S. Cl. ..... 220/334

[58] Field of Search ..... 220/1 T, 334, 335

[56] References Cited

U.S. PATENT DOCUMENTS

| | | | |
|---|---|---|---|
| 1,732,988 | 10/1929 | Ruhmann | 220/335 |
| 1,757,740 | 5/1930 | Rosner | 220/335 |
| 1,917,363 | 7/1933 | Fohn | 220/334 |
| 2,112,208 | 3/1938 | Gibson | 220/334 |
| 2,222,375 | 11/1940 | Roccabruna | 220/334 |
| 3,125,239 | 3/1964 | Baker | 220/334 |
| 4,019,274 | 4/1977 | Landell | 220/335 |

*Primary Examiner*—George E. Lowrance

*Attorney, Agent, or Firm*—Birch, Stewart, Kolasch & Birch

[57] ABSTRACT

A trash receptacle includes a trash container having a top which can be opened, an aperture disposed in one of the side walls of the container, a door mounted by a hinge to close said aperture, the door biasing mounted to the interior of the side wall to open into the container, and spring bias means operatively associated with the door for holding the door in a closed position, whereby a chemical spray apparatus mounted to a dump truck can be slidably inserted through the aperture in the trash container against the bias of the door and then retracted from the aperture, with the door automatically closes.

2 Claims, 2 Drawing Sheets

TRASH CONTAINER TO BE CHEMICAL SPRAYED

BACKGROUND OF THE INVENTION

1. Field of the Invention

The present invention relates to a trash container and more particularly to a trash container which is provided with a side door for inserting therein an extendable spray apparatus mounted to the front end of a dump truck. After the interior of the container is disinfected by the spray apparatus, it is removed from the trash container through the door.

2. Description of the Prior Art

It is conventional practice in the prior art to use a trash container having a top door disposed at the top portion thereof. After a dump truck is used to remove the solid waste from the container, the trash container is usually disinfected by spraying chemicals through a sprayer which is positioned far from the trash container. Therefore, it is difficult to completely disinfect and sterilize the container. Furthermore, if the spraying power of the disinfectant device is weak, the fluid cannot reach the more remote interior portions of the trash container.

SUMMARY OF THE INVENTION

Accordingly, it is an object of the present invention to provide a trash container which effectively cooperates with an extendable chemical spray apparatus mounted to a dump truck.

Another object of the present invention is to provide a trash container which is provided with a door disposed on one of the side walls thereof, the door being hinged to open into the trash container so that the spray gun of an extendable chemical spray apparatus can be easily introduced into the trash container and slidably removed therefrom through the door.

A further object of the present invention is to provide a trash container having the door which is hinged to the interior wall thereof and biased in a closed portion against said interior wall for preventing the door from opening. The presence of the solid waste materials in the trash container also functions to hold the door in a closed position.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a trash container comprising a side door having a bent end portion, which cooperates with a disinfecting device, that is, a spray gun of a chemical spray apparatus mounted to a dump truck. The spray gun is introduced into the trash container by pushing it against the bias of the door of the container. After the container is thoroughly sprayed, the spray gun is retracted from the container through the door, and the door automatically closes the interior of the container to the environment.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
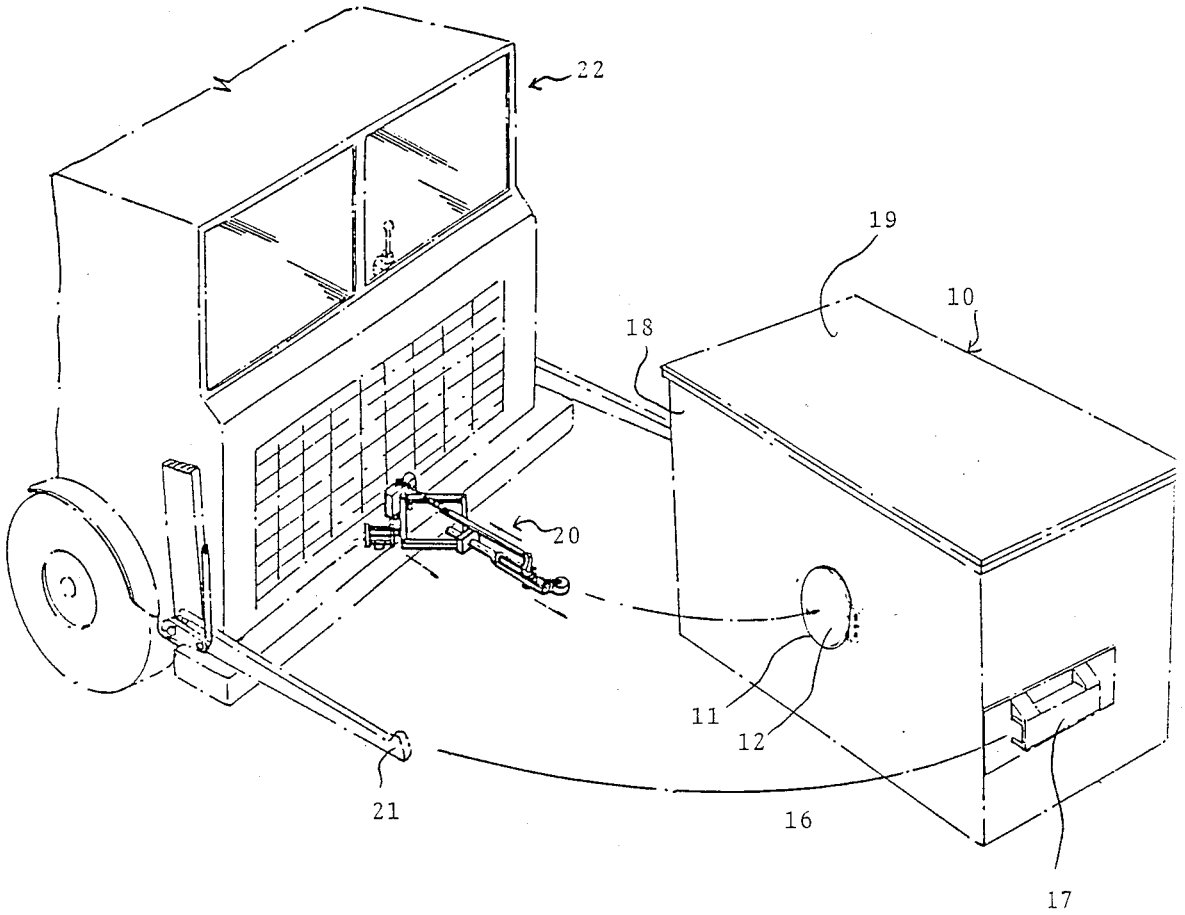
FIG. 1 is a perspective view showing how a chemical spray apparatus mounted to a dump truck can be utilized to a trash container.
Figure 2:
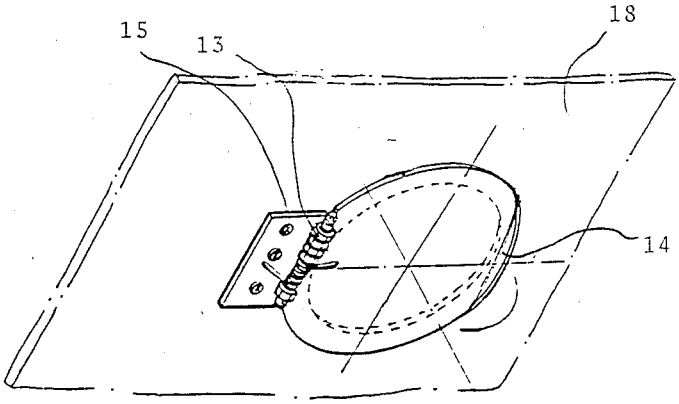
FIG. 2 is a perspective view of a door secured to an interior wall of a trash container.

Referring now in detail to the drawings for the purpose of illustrating the present invention, the trash container 10 as shown in FIGS. 1 and 2 comprises an aperture 11 disposed at the front side wall 18 thereof, and a door 12 adapted to close on the aperture 11. The door is attached to the interior of the side wall 18 through a hinge 13 with bolts 15 and nuts 16 so that the door opens (swings) into the container. A pair of handle members 17 are provided for engaging with hooks 21 disposed on the dump truck 22.

The door 14 contains a bent lip end portion 14 disposed opposite from the hinge 13. Since the door is attached to an interior side wall of the container, it is held by the spray against the wall of the container whereby damage to the door 12 during the dumping operation is avoided. During the dumping procedure, hooks 21 located at the front end of the dump truck engage the handle members 17. At this time, the solid waste materials are dumped from the trash container 10 through the top of the container 19, and into dump truck 22. As noted hereinabove, the bent lip end portion 14 is provided on the door 12 to facilitate the introduction of the spray device into the interior of the container. The bent lip end portion has a slope of 15° to 20° to provide a smooth rolling surface for a guide roller 23 disposed at the front end of the spray device.

Figure 4:
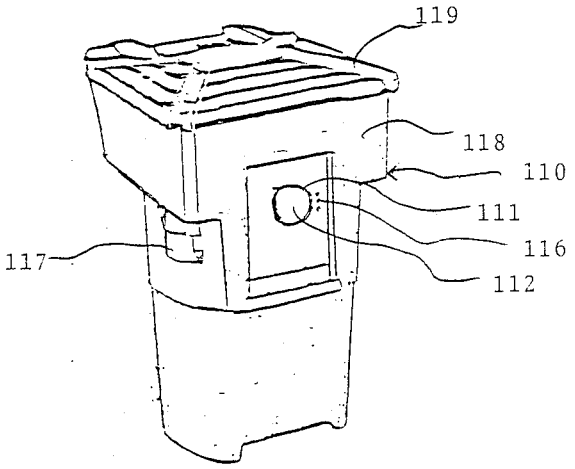
FIG. 4 is a perspective view of an alternative trash container containing the door of the present invention.

FIG. 4 shows an alternative trash container 110 of the present invention which comprises an aperture 111, disposed on the front side wall 118. A door 112, which is hinged to open into the container 110 is provided with nuts 116. The trash container 110 has a top 119 and a handle member 117.

Figure 3:
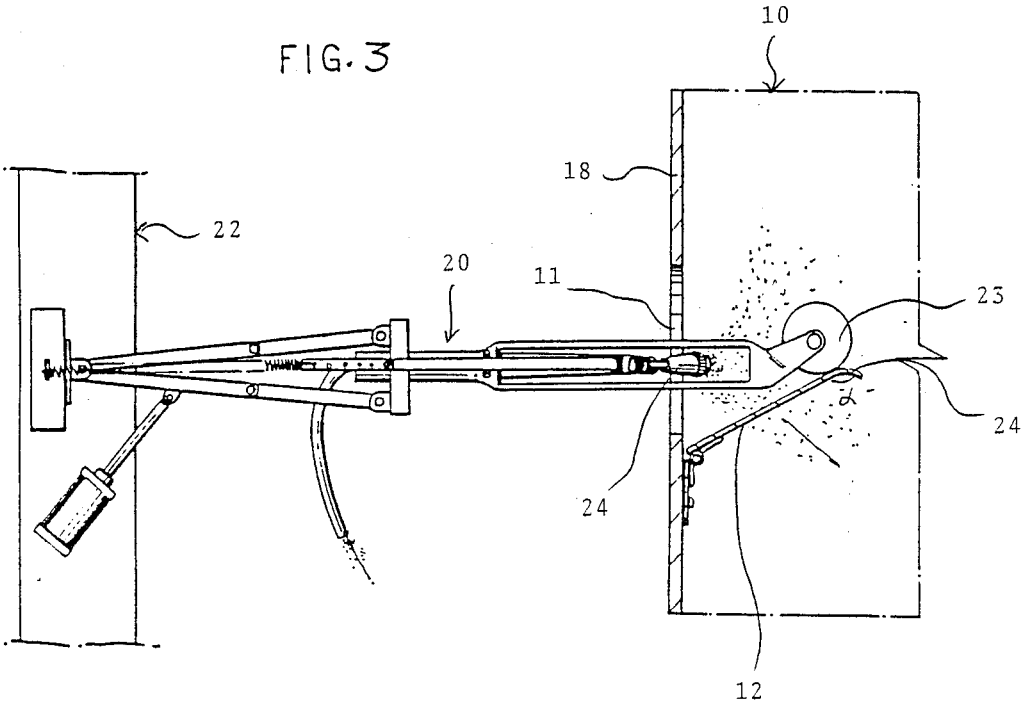
FIG. 3 is a side view showing how the chemical sprayer is inserted into the trash container through the door.

In operation, and as shown in FIG. 3, after the trash is discarded an extendable chemical spray apparatus 20 mounted to the dump truck 22 is extended to be inserted into the trash container 10 through the door 12. The guide roller 23 slidably pushes against the door 12 and eventually reaches the bent lip end portion 14. At this time, a sprayer 24 provided with a chemical spray apparatus 20 is actuated to spray around the inside of the trash container 10. As the chemical spray apparatus 20 is retracted, the guide roller 23 is slidably removed from the trash container 10.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A trash container adapted to be chemical-sprayed internally which comprises:

a trash container having a top which can be opened, an aperture disposed in one of the side walls of said trash container, a door mounted by a hinge to close said aperture, said door biasing mounted to the interior of said side wall to open into said trash container, said door containing:

a bent lip end portion disposed opposite from said hinge, said bent lip end portion being inclined toward the inside of said trash container at a slope of 15°–20° for providing a smooth rolling surface for guiding a guide roller which supports an extensible chemical spray apparatus, said extensible chemical spray apparatus being slidably inserted against the bias of the door through the aperture and slidably removed from the trash container through said door, and handle means disposed on opposite sides of the trash container, whereby the door is provided to accommodate the extensible chemical spray apparatus and the handle means are provided to accommodate a pair of lifting arms mounted to the dump truck so that the trash container can be simultaneously emptied and disinfected in a single operation.

2. The trash container of claim 1 wherein the hinge attached to the door is mounted to left or right side portion of the aperture of the trash container.

* * * * *